US009173791B2

(12) United States Patent
Jensen et al.

(10) Patent No.: US 9,173,791 B2
(45) Date of Patent: Nov. 3, 2015

(54) LIGHTWEIGHT ABSORBENT TRANSPORTER

(75) Inventors: Ronald Jensen, Chicago, IL (US); Richard Beu, Yorba Linda, CA (US); Sayandro Versteylen, Ontario, CA (US)

(73) Assignee: Paper-Pak Industries, Laverne, CA (US)

( * ) Notice: Subject to any disclaimer, the term of this patent is extended or adjusted under 35 U.S.C. 154(b) by 0 days.

(21) Appl. No.: 12/677,733

(22) PCT Filed: Sep. 12, 2008

(86) PCT No.: PCT/US2008/076293
§ 371 (c)(1),
(2), (4) Date: Mar. 11, 2010

(87) PCT Pub. No.: WO2009/036374
PCT Pub. Date: Mar. 19, 2009

(65) Prior Publication Data

US 2010/0199435 A1 Aug. 12, 2010

Related U.S. Application Data

(60) Provisional application No. 60/971,689, filed on Sep. 12, 2007, provisional application No. 60/971,580, filed on Sep. 12, 2007.

(51) Int. Cl.
*A61G 1/01* (2006.01)
*A61G 1/013* (2006.01)
(Continued)

(52) U.S. Cl.
CPC *A61G 1/013* (2013.01); *A61G 1/01* (2013.01); *A61G 1/04* (2013.01); *A61G 1/044* (2013.01); *A61G 1/048* (2013.01)

(58) Field of Classification Search
CPC ..... A61G 1/00; A61G 1/01; A61G 1/013; A61G 1/04; A61G 1/048; A41B 13/06; A47G 9/08; A47G 9/083; A47G 9/086
USPC ..... 5/628, 627, 625, 89.1, 81.1 T, 413 R, 5/484, 494; 2/69.5
See application file for complete search history.

(56) References Cited

U.S. PATENT DOCUMENTS 3,986,505 A * 10/1976 Power ..... 128/846
4,124,908 A * 11/1978 Burns et al. ..... 5/628
(Continued)

FOREIGN PATENT DOCUMENTS

DE 8016753 U1 11/1980
FR 2764186 A1 12/1998

OTHER PUBLICATIONS

International Search Report dated Nov. 17, 2008 for the corresponding PCT/US2008/076293.
(Continued)

*Primary Examiner* — Robert G Santos
(74) *Attorney, Agent, or Firm* — Ohlandt, Greeley, Ruggiero & Perle, LLP

(57) ABSTRACT

A lightweight, portable transporter for carrying a person having anti-hypothermia structures and an absorbent body is provided. The transporter has a backing substrate, an absorbent body, a gripping device, and anti-hypothermia structures, such as material segments or covers that reduce loss of body heat of the person being carried on the transporter. A method of using the transporter is provided.

20 Claims, 12 Drawing Sheets

(51) Int. Cl.

| | |
|---|---|
| ***A61G 1/04*** | (2006.01) |
| ***A61G 1/048*** | (2006.01) |
| ***A61G 1/044*** | (2006.01) |

(56) References Cited

U.S. PATENT DOCUMENTS

| | | | | |
|---|---|---|---|---|
| 4,579,753 | A * | 4/1986 | Gjendemsjo | 428/17 |
| 5,044,031 | A * | 9/1991 | Sherwood et al. | 2/69.5 |
| 5,061,235 | A | 10/1991 | Hogan | |
| 5,189,746 | A * | 3/1993 | Horie | 5/627 |
| 5,699,568 | A * | 12/1997 | Couldridge | 5/628 |
| 6,199,232 | B1 | 3/2001 | Kocivar | 5/502 |
| 6,440,160 | B1 | 8/2002 | Cordani | |
| 8,640,288 | B2 * | 2/2014 | Jensen et al. | 5/625 |
| 8,959,682 | B2 * | 2/2015 | Jenson et al. | 5/626 |
| 2005/0051203 | A1 | 3/2005 | McCully et al. | 5/656 |
| 2006/0057918 | A1 | 3/2006 | Burnett | 442/327 |
| 2010/0011506 | A1 * | 1/2010 | Jensen et al. | 5/627 |
| 2010/0199435 | A1 * | 8/2010 | Jensen et al. | 5/628 |
| 2012/0284923 | A1 * | 11/2012 | Jensen et al. | 5/627 |
| 2014/0123393 | A1 * | 5/2014 | Jenson et al. | 5/625 |

OTHER PUBLICATIONS

Office Action dated Mar. 12, 2013 for corresponding Canadian Patent Application No. 2,699,374 consisting of 3 pages.

Mexican Office Action (with English translation) dated Feb. 27, 2014 for Mexican application No. MX/a/2010/002819.

Extended European Search Report dated May 23, 2014 for European application No. 08830657.6.

* cited by examiner

LIGHTWEIGHT ABSORBENT TRANSPORTER

BACKGROUND OF THE INVENTION

1. Field of Invention

The present disclosure is a lightweight, absorbent transporter that is portable and disposable and, most preferably, has an anti-hypothermia structure to reduce the loss of the person's body heat during transport. The transporter provides sufficient strength, durability, and insulation to support the weight of an injured soldier or patient and reduce the risk of hypothermia. Methods of using such a transporter are also provided.

2. Description of the Related Art

Pieces of heavy cloth, such as canvas or similar materials, and leather attached to wood or metal poles have long been used as litters and stretchers for transporting injured soldiers and patients in emergency situations. For purposes of this application, "litters" and "stretchers" are used interchangeably to indicate a transport device to carry injured soldiers or patients. In medical settings, litters and stretchers are used to transport patients from the site of injury to a medical care facility, or to a vehicle, such as an ambulance or helicopter, that will take the injured patient to a medical care facility. Litters can also be used to for shorter transport needs, such as transfers from a stationary bed or cot to another area within the medical center.

Hypothermia, or loss of body heat, can be a problem when transporting injured soldiers or patients. Conventional litters that are made of a piece of strong cloth (such as canvas) or leather stretched between poles, provide no top cover on the person being transported to prevent loss of body heat, nor is the litter material able to sufficiently reduce additional loss of body heat from the underside of the patient's body through the litter itself. Significant body heat still can be lost on a conventional stretcher even when blankets are placed on the patient, because the blankets are not connected to or secured to the transporter. Hypothermia is a particular concern when transporting injured soldiers or patients in cold environments, or in windy, wet conditions, but hypothermia can also cause significant morbidity, and even mortality, in response to loss of blood from injury or the body's normal physiological responses to severe injury.

Another problem with conventional litters is that such litters, when large and strong enough to support and carry an injured soldier or patient, are too heavy and difficult to be carried by one soldier. Conventional litters with material stretched between two poles must be lifted for transport, and can not be dragged along the terrain by a single person since the injured soldier and gear are too heavy to effect transport, especially in battlefield conditions.

In addition, blood or body fluids, such as urine, feces or emesis, from an injured soldier or patient will contaminate the stretcher and thus infect the injured soldier or patient or any other person placed on the stretcher. Also, blood and/or body fluids that contact conventional stretchers can make the top surface of the stretcher slippery, increasing the risk that the person may shift or even fall off of the litter during transport, particularly during transport in rugged terrain or under battlefield conditions. Thus, in such instances, the stretcher-bearers must move slowly to avoid causing further injury, thereby exposing the patient to environmental conditions or even battlefield hazards for a longer time.

Transportation vehicles that take the injured soldier or patient to a medical care facility, such as by helicopter, boat, or automobile, may expose the injured soldier or patient to forceful winds because of the movement of the vehicle. In such conditions, placing a soldier or patient on a litter and tucking a blanket around the patient does not provide a reliable way to secure the patient and keep him warm, since the blanket may loosen or even fall because of the wind generated by the vehicle's movement. In addition, if the patient is bleeding or has an open wound, infectious material may be transferred to the other injury sites, to the transport carriers, or even to other soldiers or patients being transported in the same vehicle.

Therefore, there exists a need for a lightweight, portable transporter that has an anti-hypothermia structure to reduce the loss of the person's body heat during transport, and can absorb blood or other body fluids from the person being carried. In addition, the transporter should be foldable to reduce size for efficient storage and shipping before use.

SUMMARY OF THE INVENTION

The present disclosure provides a lightweight, absorbent transporter for carrying a person, such as an injured soldier or patient, that has an anti-hypothermia structure to reduce the loss of body heat from the transported person.

The transporter has a backing substrate, an absorbent body on the backing substrate, a gripping device connected to the backing substrate, and an anti-hypothermia structure, where the anti-hypothermia structure reduces loss of body heat of the person being transported.

The anti-hypothermia structure has one or more material segments. The material segment is a lightweight insulating material, and can have an outer layer that serves as a barrier to protect the person from wind or wetness and an inner layer to transfer moisture away from the person being transported. At least one material segment extends at least half-way across an extant (width, length, and/or height) of the transporter.

The gripping device can be cutouts (holes) or straps connected to the transporter that permit the transporter to be manually lifted and carried during transport. Also, the gripping devices permit the transporter to be carried by one or more rigid bodies (such as poles) that can be inserted in the gripping devices.

The absorbent body is positioned on the backing substrate to absorb blood and body fluids from the person being transported. The person is placed on the absorbent body during transport. The absorbent body can have a top surface that does not adhere to the person, and that permits blood and body fluids to pass through to the absorbent or superabsorbent layers in the absorbent body. The absorbent body keeps the person dry and comfortable, and reduces the risk of contamination.

The transporter may have an active agent to reduce infection and contamination of the transporter by microbial pathogens, and can reduce and/or eliminate odors. Active agents can be positioned anywhere on and/or in the transporter, preferably on an/or in the absorbent body.

Methods for using an anti-hypothermia transporter of the present disclosure for carrying a person are also provided. To use the anti-hypothermia transporter, the transporter is opened and the person is positioned on the absorbent body of the transporter. One or more material segments of the anti-hypothermia structure is placed on the person to cover a portion of his body to reduce loss of body heat during transport. The person is then transported by one or more carriers.

The transporter is particularly suited for military use, because of its lightweight, strength, anti-hypothermia structure, ruggedness, and portability. The transporter is likewise useful for transporting injured civilians by first-response unit personnel, such as ambulances, helicopter rescue, firemen and forestry workers, where direct access to the site of injury by rescue units is difficult. Transporters of the present disclosure can also be easily stored for use where the numbers of injured persons is potentially large, such as at sports stadiums, airports, and large office buildings.

DETAILED DESCRIPTION OF THE INVENTION

Figure 1:
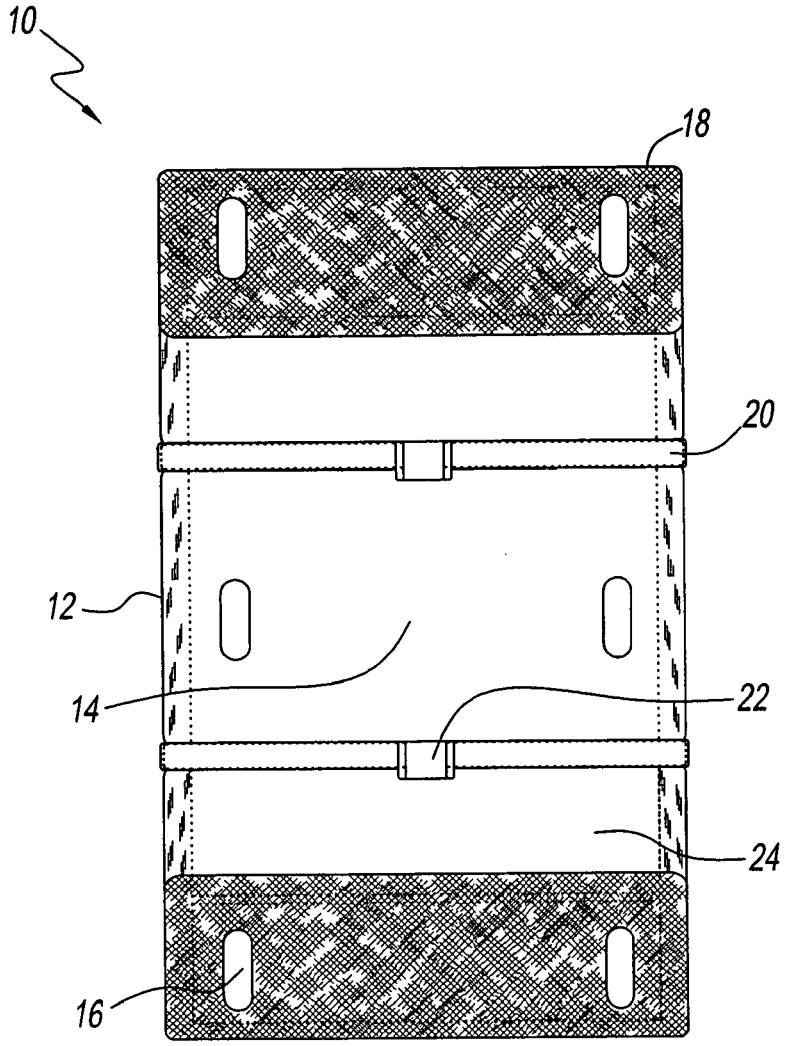
FIG. 1 is a plan view of a transporter of the present disclosure, (anti-hypothermia structure not shown).

Referring to the drawings and, in particular, FIG. 1, there is provided a transporter generally represented by reference numeral 10. Transporter 10 has a backing substrate 12 and an absorbent body 14 positioned on backing substrate 12. In an exemplary embodiment shown in FIG. 14, transporter 10 has an anti-hypothermia structure.

Transporter 10 has one or more gripping devices 16 that are positioned at the ends and/or along the sides of transporter 10. In the embodiment in FIG. 1, gripping devices 16 pass through backing substrate 12 and absorbent body 14, but, alternatively, gripping device 16 may pass through backing substrate 12 but not absorbent body 14.

Transporter 10 has a binder 18 that is connected or attached along one or more sides of transporter 10.

Transporter 10 can have one or more securing straps 20, each of which connects across a width or length of transporter 10. Each securing strap 20 can have a tension-adjusting buckle 22.

Transporter 10 is a portable transporter for carrying a person, such as an injured soldier or patient. When not in use, transporter 10 can be folded to a compact size to be easily carried. As shown in FIG. 1, transporter 10 can have one or more flat panels 24 to aid in folding the transporter. Transporter 10 can be disposable after one or more uses.

Figure 14:
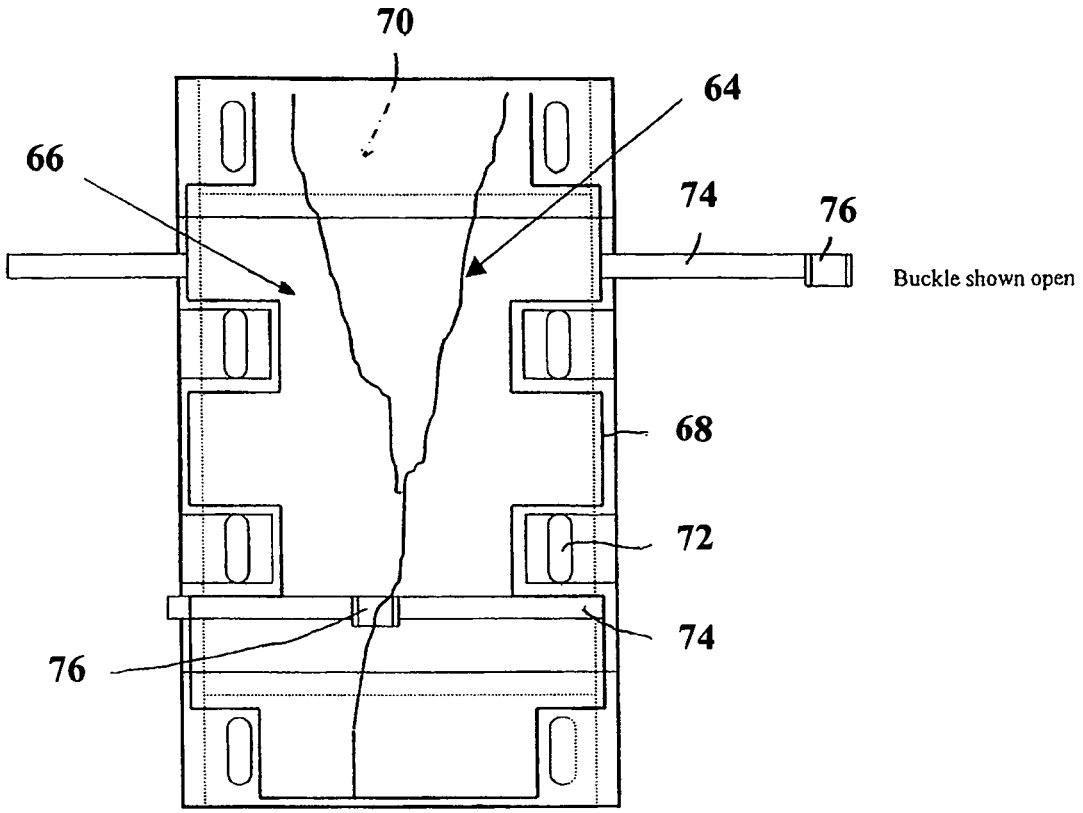
FIG. 14 is a plan view of a transporter of FIG. 1 having material segments as anti-hypothermia structures.

Transporter 10 is lightweight in construction. The weight of transporter 10 is less than about 150 grams/meter$^2$ (g/m$^2$). Transporter 10, including the anti-hypothermia structure, such as shown in FIG. 14, has a total weight of less than 4 pounds. The weight of transporter 10, without an anti-hypothermia structure (as shown in FIG. 1), is less than 3 pounds.

Transporter 10 has outer dimensions that are at least 18 inches in width and at least 65 inches in length. A preferred embodiment of transporter 10 is about 78 inches in length by about 33.5 inches in width.

Transporter 10 can support a person that weighs at least 250 pounds (113.6 kilograms). Transporter 10 can preferably support a person that weighs at least 300 pounds (136.4 kg), and more preferably a person that weighs at least 350 pounds (159.1 kg).

As used herein, the terms "carry" and "transport" are used interchangeably.

As shown in FIG. 1, backing substrate 12 forms the back portion of transporter 10. Backing substrate 12 preferably covers the entire back surface of transporter 10 and can be folded over the top surface of transporter 10. Backing substrate 12 can cover a portion of absorbent body 14, and preferably covers the back portion of absorbent body 14. Alternatively, backing substrate 12 does not have to cover any part of absorbent body 14. As an exemplary embodiment, absorbent body 14 may be removably attached to backing substrate 12 without being covered by backing substrate 12, such that the absorbent body can be removed from transporter 10 and replaced by a new absorbent body 14 that is positioned on backing substrate 12. Backing substrate 12 is folded at the top and bottom edges of the transporter to form a top edge and a bottom edge, respectively, of transporter 10. Backing substrate 12 is secured in position by thread, adhesive, or interlocking materials such as VELCRO® (Velcro Industries B.V. LLC Netherlands, Curacao, Netherlands Antilles). Backing substrate 12 is preferably adhered to the top of transporter 10 by sewing across the width of the transporter. When folded over the top surface of transporter 10, backing substrate 12 extends a distance of at least 1 inch to about one-quarter of the total length of transporter 10.

Backing substrate 12 can be made of material that includes, but is not limited to, nylon, nylon composite material, strong cloth material, canvas, hemp, flax, cotton fiber materials, polyethylene, polypropylene, polymer films, or any combinations thereof. A preferred embodiment of backing substrate 12 is made of nylon material. Another embodiment of backing substrate 12 is made of cotton or canvas material. Another embodiment of backing substrate 12 is made of polyethylene and/or polypropylene films. Backing substrate 12 provides durability, strength, weather-resistance, and ruggedness to transporter 10. Backing substrate 12 is preferably made of material that is puncture-resistant. Puncture resistance is particularly useful for those embodiments of transporter 10 likely to be used to carry an injured person over rugged terrain or rough surfaces, especially where a single person is effecting a rescue and carry, and must pull transporter 10 and the person over the terrain. Backing substrate 12 provides a wind barrier and moisture barrier that protects and secures the person being carried on transporter 10.

Backing substrate 12 can be of any color and/or patterns that facilitate military and civilian applications of transporter 10. Examples of colors and/or patterns include, but are not limited to, black, white, khaki, and/or camouflage.

Transporter 10 may also have one or more access slits passing through backing substrate 12 and/or material segments 64, 66 (in FIG. 14). The access slits provide access for medical personnel to the person being transported and provide passage for tubes needed to treat the person. Such slits are closeable, to provide a seal around any object passing through the access slits. Closures for access slits may be any closure means, such as hook and loop fasteners that are commercially available as VELCRO® (Velcro Industries B.V. LLC Netherlands, Curacao, Netherlands Antilles).

Absorbent body 14 is an absorbent material or superabsorbent material that is suitable for absorbing large amounts of fluids. Examples of absorbent and superabsorbent materials that can be used for absorbent body 14 include, but are not limited to, an airlaid, an airlaid composite, fluff pulp, bonding fiber, superabsorbent polymer (SAP), compressed SAP composite of SAP polymer granules adhered with one or more binders and/or plasticizers, compressed composite containing a percentage of short or microfiber materials, thermoplastic polymer fibers, thermoplastic polymer granules, cellulose powders, cellulose gels, an airlaid with SAP, a fibrous or foam structure that has been coated or impregnated with a SAP, an absorbent structure having one or more starch or cellulose based absorbents or containing superabsorbent material formed and/or crosslinked, or any combinations thereof. Superabsorbent materials used in the present disclosure can be used in various forms that include, but are not limited to, granular, fiber, liquid, superabsorbent hot melts, and any combinations thereof. A preferred embodiment of the present disclosure has a top surface or layer of absorbent body 14 that is made of a polymer film, such as polyethylene or polypropylene film. Another preferred embodiment has a top surface of absorbent body 14 that is made of non-woven material, such as airlaid formed on a non-woven. The top surface of absorbent body 14 may also be made of a non-slip material, or treated with a non-slip agent, to reduce movement or slipping of a person carried on transporter 10, particularly if the top surface of absorbent body 14 becomes wet from use in snow or rain, or from various body fluids.

The top surface of the absorbent body 14 can be any color and/or pattern that facilitates military and civilian applications of transporter 10. Examples of colors and/or patterns include, but are not limited to, black, white, khaki, and/or camouflage.

Transporter 10 can also contain an active agent. The active agent may be one or more bactericide, fungicide, virucide, disinfectant, sanitizer, sterilizer, mildewstat, surfactant, deodorizer, and/or any combinations thereof. Active agents include, but are not limited to, a metal, metal compound, surface active agent, quaternary ammonium compound, organic acid, inorganic acid, salt, sulfite, biopolymer, synthetic polymer, chitin, chitosan, nisin, enzyme, arginate, diacetate, antioxidant, and any combinations thereof. The one or more active agent may be positioned on and/or in any structure of transporter 10. Preferably, the active agent is on and/or in absorbent body 14. The active agent may be added in its active form, or alternatively, in an inactive form that becomes activated upon contact with other agents, moisture or fluids.

Absorbent body 14 may also contain, or be treated with, a surfactant. The surfactant enhances absorption of fluids by absorbent body 14. Examples of surfactants that can be used in the present disclosure include anionic surfactants, cationic surfactants, zwitterionic surfactants, and non-ionic surfactants.

Absorbent body 14 may have one or more strengthening layers to improve the strength and/or resistance to tearing of absorbent body 14. The one or more strengthening layers can be located on top of, below, or in between any portion of absorbent body 14. A strengthening layer for absorbent body 14 may be made of standard non-woven material, or meltblown or spunlace composites. An exemplary embodiment is a polypropylene non-woven or polypropylene/meltblown non-woven material.

Binder 18 is connected along a side of transporter 10. Binder 18 provides a defined edge to transporter 10 and reinforces the integrity and shape of the transporter when in use. Binder 18 can be made of a webbing material such as polyester or polypropylene. Binder 18 may be attached to transporter 10 with thread, adhesive, and/or other attachment means or fastener (for example, hook-and-loop fasteners commercially available as VELCRO®, Velcro Industries B.V. LLC Netherlands, Curacao, Netherlands Antilles). Binder 18 can be attached onto the edge of transporter 10 extending from the edge to a width that is between about one-quarter (¼) inch to about 2 inches, with a preferred width from the edge that is about 1.25 inches along a long edge of transporter 10. "About," as used in this application, means plus or minus 0.25 inches. Binder 18 provides additional integrity to transporter 10, and makes transporter 10 finished in appearance.

As shown in the embodiment in FIG. 1, one or more securing straps 20 with tension-adjusting buckle 22 can be used to secure the person to transporter 10. Securing strap 20 is positioned to extend across the width of transporter 10. The end of securing strap 20 can be folded about 1.5 inches to about 6 inches under the edges of transporter 10. The securing strap 20 can be extended under the pad to a dimension of about 4 inches. There may be from zero to seven securing straps 20. Preferred embodiments have two or three securing straps 20. Each securing straps 20 can be made of cloth, canvas, nylon, nylon-based material, or synthetic materials. Each securing strap 20 can be placed above or beneath the binder 18, and is preferably placed beneath binder 18. Each securing strap 20 has one or more tension-adjusting devices, such as buckle 22.

Gripping device 16 is positioned anywhere along the perimeter of transporter 10, such as at the edges and/or along the sides of the transporter. The one or more gripping devices 16 are preferably positioned symmetrically along the ends and/or along the sides of transporter 10. Gripping device 16 may be straps or may be holes, eyelet loops, or any other device passing through backing substrate 12 and/or absorbent body 14. Each gripping device 16 permits manual gripping and lifting by one serving as a carrier of transporter 10, or insertion of one or more rigid structures, such as poles, or any combinations of these, to enhance the ease of carrying transporter 10 with a person thereon. The present disclosure provides a plurality of gripping devices 16. An exemplary embodiment of transporter 10 has one to ten gripping devices 16 positioned at any location at transporter 10. Another exemplary embodiment has four to eight gripping devices 16 that are positioned along the perimeter of transporter 10.

Transporter 10 may be constructed to form one or more flat panels 24. Flat panels 24 provide additional strength to transporter 10, and permit greater ease in folding transporter 10. Various folding configurations may be used for transporter 10, such as a "flat-over roll" configuration (as shown in FIG.

5), or "accordion" folding configuration, to reduce the size of transporter 10 when not in use and thereby enhance portability.

Figure 2:
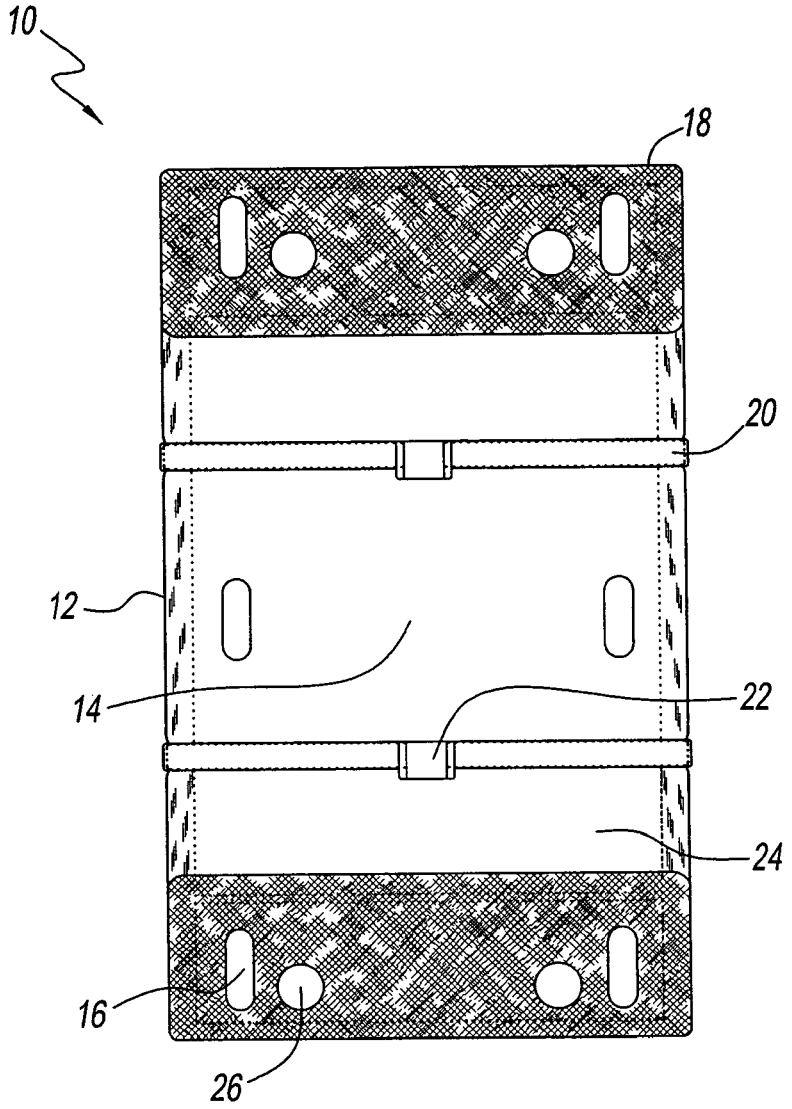
FIG. 2 is a plan view illustrating an embodiment having circular cutouts on each end of the transporter of FIG. 1.

FIG. 2 illustrates an embodiment of transporter 10 having circular cutouts 26 that serve as additional gripping devices 16, or as slots through which rigid structures 28 can be inserted.

Figure 3:
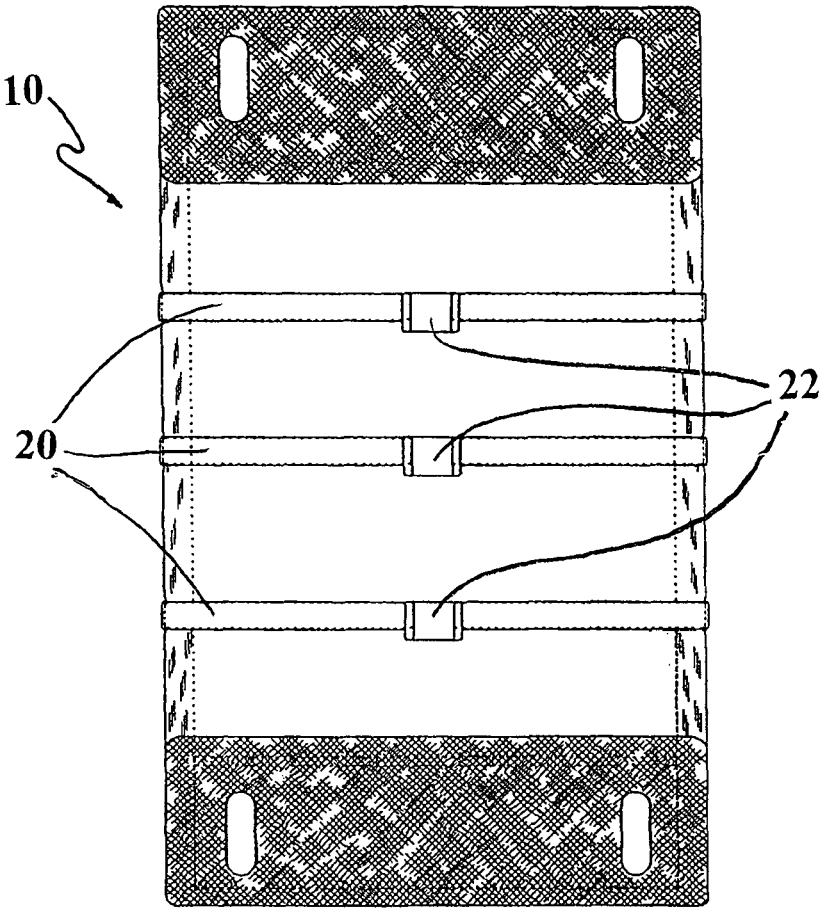
FIG. 3 is a plan view of another embodiment having three securing straps of the transporter of FIG. 1.

FIG. 3 illustrates an embodiment of transporter 10 having three securing straps 20 and buckles 22 to secure the person being carried thereon.

Figure 4:
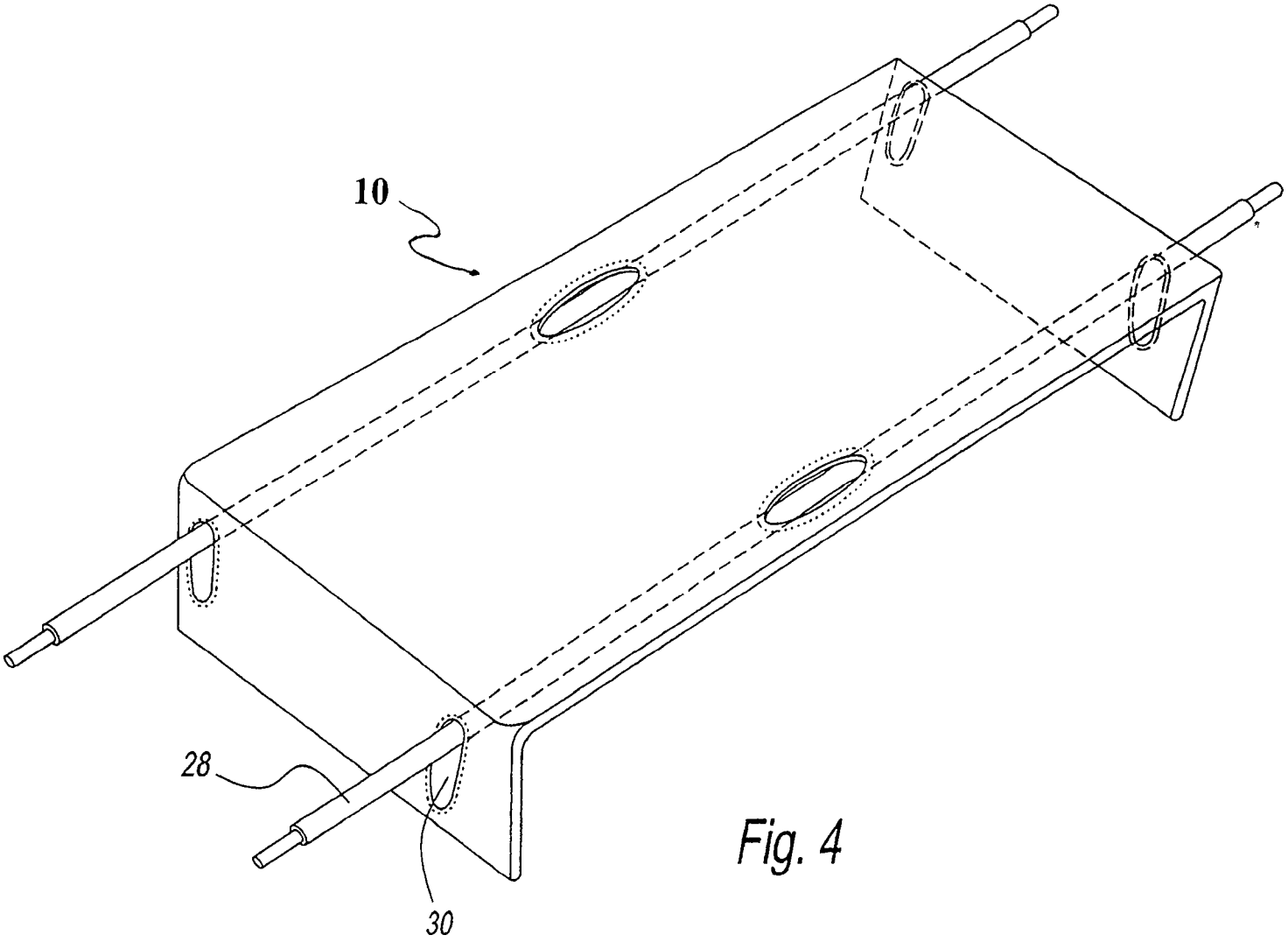
FIG. 4 is a perspective view of the transporter of FIG. 1 illustrating an embodiment having rigid bodies (telescoping poles) inserted.

Referring to FIG. 4, transporter 10 of the present disclosure may include a rigid body 28 that is passed through one or more gripping device 16. Rigid bodies 28 can be any solid or hollow body that can be passed through gripping device 30. Rigid bodies 28 are preferably made of metal, polymer, or wood. Each rigid body 28 is preferably a pole. As an example, rigid body 28 can be a hollow polyvinyl chloride pole. Each rigid body can be solid or hollow structures, depending on the need for strength and reduced weight. The cross-section of rigid body 28 may be any shape, with preferred embodiments having round, ovate, or flat cross-sections. As shown in the embodiment in FIG. 4, rigid body 28 can have a "telescoping" configuration to enhance portability when not in use, where "telescoping" means that certain sections of rigid body 28 are sized to pass inside another section, in the manner of a telescope. Additional rigid bodies 28 can also be positioned at other locations in, or under, the surface of transporter 10, and in any direction or orientation for muscular support to the person. FIG. 4 illustrates an embodiment of transporter 10 with two telescoping rigid bodies 28 that are metal poles inserted through certain gripping devices 30. This configuration enables transporter 10 to be carried more easily by two or more persons acting as carriers. Also, this structure provides additional support for the integrity of transporter 10 and, moreover, anatomic support for a person carried on the transporter.

Figure 5:
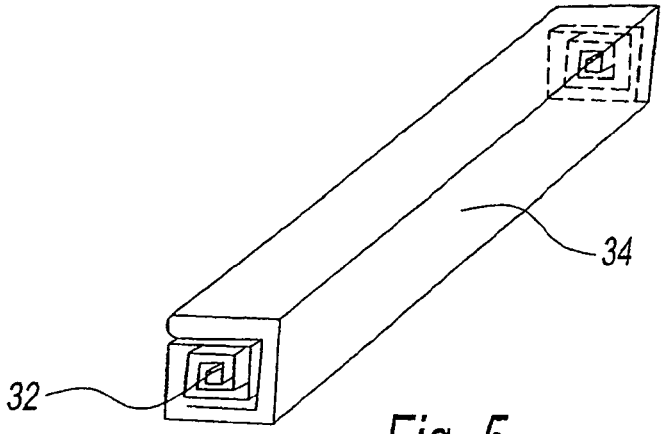
FIG. 5 is a perspective view of the transporter of FIG. 1 folded in flat-over roll configuration.

Referring to FIG. 5, transporter 10 is foldable into a flat roll, such as configuration 32. Folding reduces the size of transporter 10 when the transporter is not in use, thereby enhancing portability, and minimizing storage space. Various folding configurations may be used to reduce the size and volume of the transporter. The size of the transporter 10 may be further compressed by positive or negative pressure, where an example of negative pressure is evacuation of trapped air in the folded transporter by a vacuum pressure. Using a flat-roll configuration 32, each flat panel 24 (illustrated in FIG. 1) is folded in the same direction so that the outer side of the roll forms an unbroken surface 34. Other folding configurations for transporter 10 can also be used, such as an "accordion" or "map" configuration (not shown), where each flat panel 24 of the transporter is folded in alternating directions, resulting in an exterior surface with small gaps between flat panels of flat panels.

Figure 6:
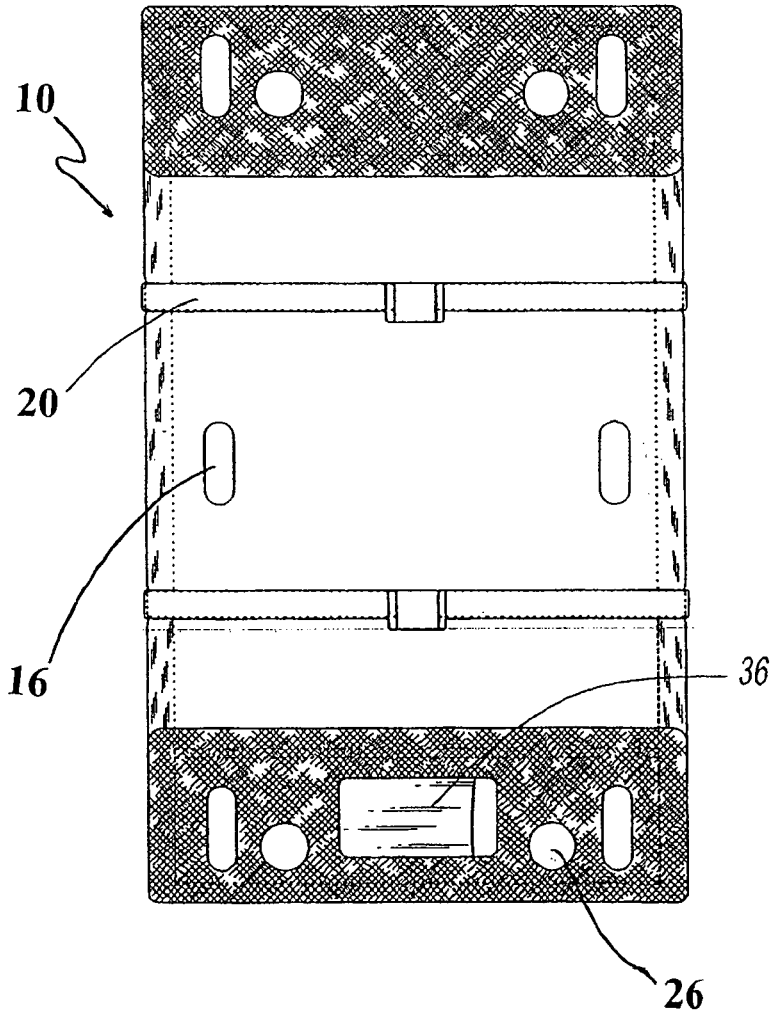
FIG. 6 is a plan view of FIG. 2 illustrating an embodiment of a transporter having a pouch.

FIG. 6 illustrates an embodiment of transporter 10 having a pouch 36. The one or more pouches 36 can be positioned on the perimeter section on one or both ends of transporter 10. Pouch 36 may be used to carry medical supplies or medications, patient information and medical charts, or the patient's or soldier's personal clothing or property.

Figure 7:
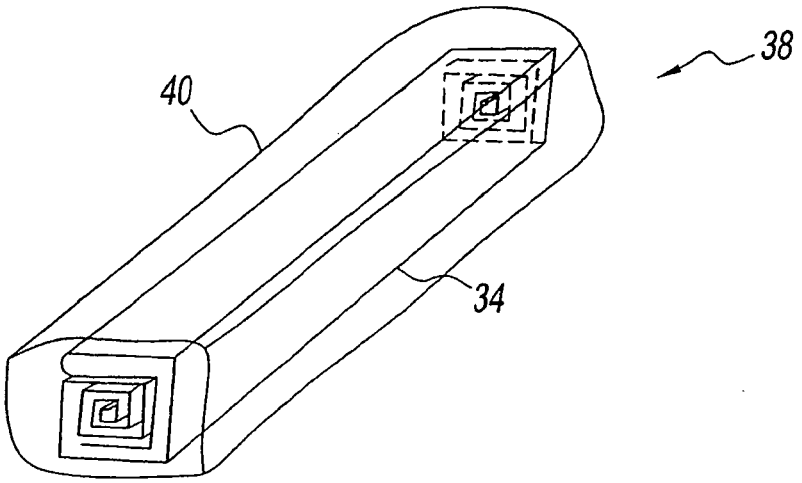
FIG. 7 is a perspective view of a kit with the transporter of FIG. 5 enclosed in a water-resistant case.

FIG. 7 illustrates kit 38, having a transporter 10 with backing substrate 12, absorbent body 14 positioned on backing substrate 12, gripping device 16, and a water-resistant case 40 enclosing transporter 10. Transporter 10 can be folded within case 40 to enhance portability. The water-resistant case 40 can be closed and/or sealed. Once sealed, case 40 may have some or all of the air evacuated by vacuum or negative pressure, to reduce the size of the kit, enhance portability, and reduce the likelihood of contamination or absorption of moisture by the absorbent body 14 prior to use. Preferably, transporter 10 is folded in flat roll configuration 34 or in accordion configuration before being enclosed by water-resistant case 40.

Figure 8:
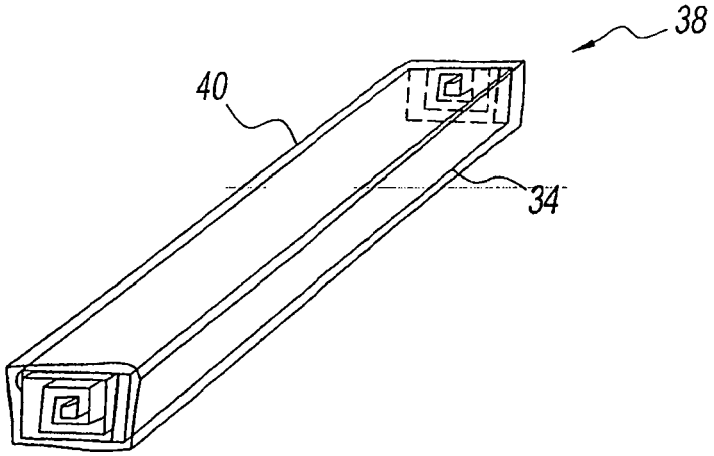
FIG. 8 is a perspective view illustrating a kit of FIG. 7 that is sealed and compressed by evacuating air from within the water-resistant case.

Referring to FIG. 8, kit 38 is shown in compressed configuration, after case 40 is closed and sealed and some or all of the air inside case 40 has been removed by vacuum. Removing air within case 40 shrinks the overall size and weight of kit 38, thereby further improving the portability of kit 38, and reducing storage space.

In an embodiment of the present disclosure, the transporter 10 is folded and placed in vacuum sealed bags to have approximate dimensions of 17 inches in width×23 inches in length×3 inches in height, which corresponds to a volume of approximately 0.019 $m^3$. However, the folded dimensions of the transporter may range from about 10 inches to about 24 inches in width, about 16 inches to about 36 inches in length, and about 1 inch to about 10 inches in height.

Figure 9:
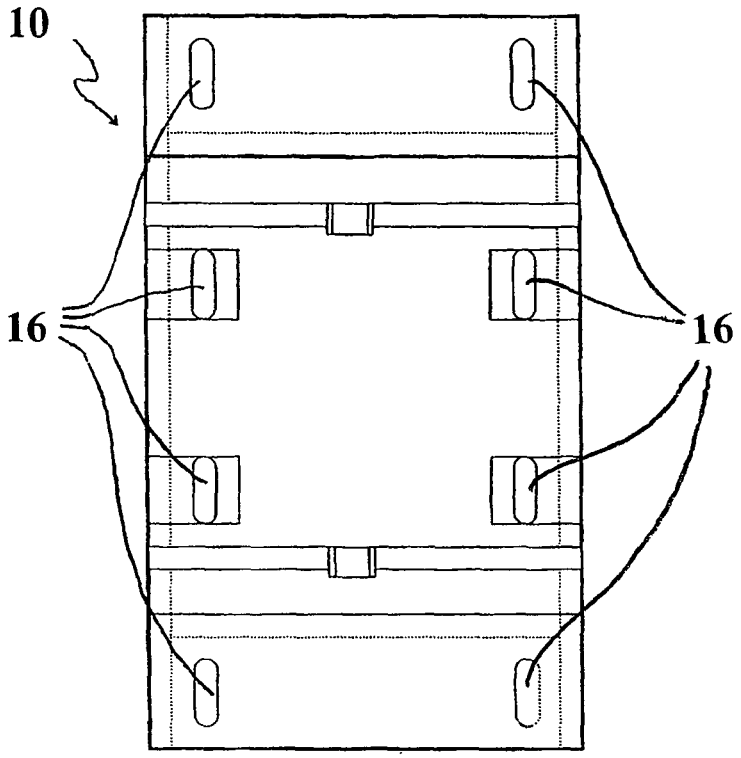
FIG. 9 is a plan view of a transporter having four gripping devices on each side of the transporter (totaling eight gripping devices).

Referring to FIG. 9, an embodiment of transporter 10 is shown having four pairs of gripping devices 16, for a total of eight gripping devices.

Figure 10:
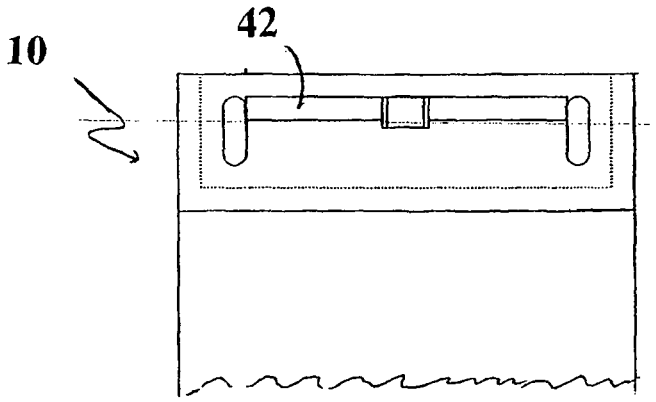
FIG. 10 is a plan view (cut away) of the back side of the transporter, illustrating a strap added across the top of the back of the transporter, permitting the transporter to be secured to a carrying system.

Referring to FIG. 10, which is a cut away view of the underside of the transporter, a strap 42 is shown. Strap 42 may be one or more straps. Strap 42 may be used to help secure the transporter for security during transport. For example, strap 42 may be used to help secure the transporter to a typical TALON-type device for security during transport, particularly for helicopter evacuations and windy conditions.

Figure 11:
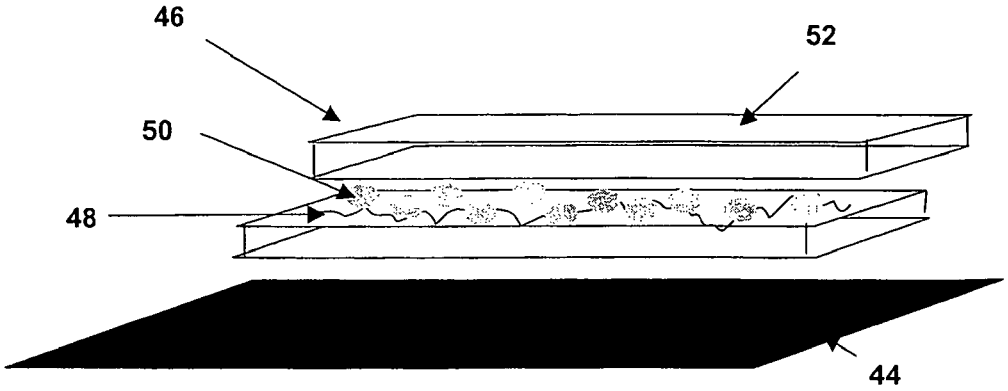
FIG. 11 is a schematic of an embodiment of an absorbent body for the transporter having an active agent between layers of composite material.

Referring to FIG. 11, an embodiment of the present disclosure is provided where an antimicrobial agent 50 is placed between two or more composite layers 46, 48 that make up the absorbent core. Two layers are shown in FIG. 11, but more absorbent layers may be used in other embodiments. Nonwoven cover stock 52 is covering the top of each layer. A backing substrate 44, made of a material such as polyethylene, can be sized for the product being produced.

Figure 12:
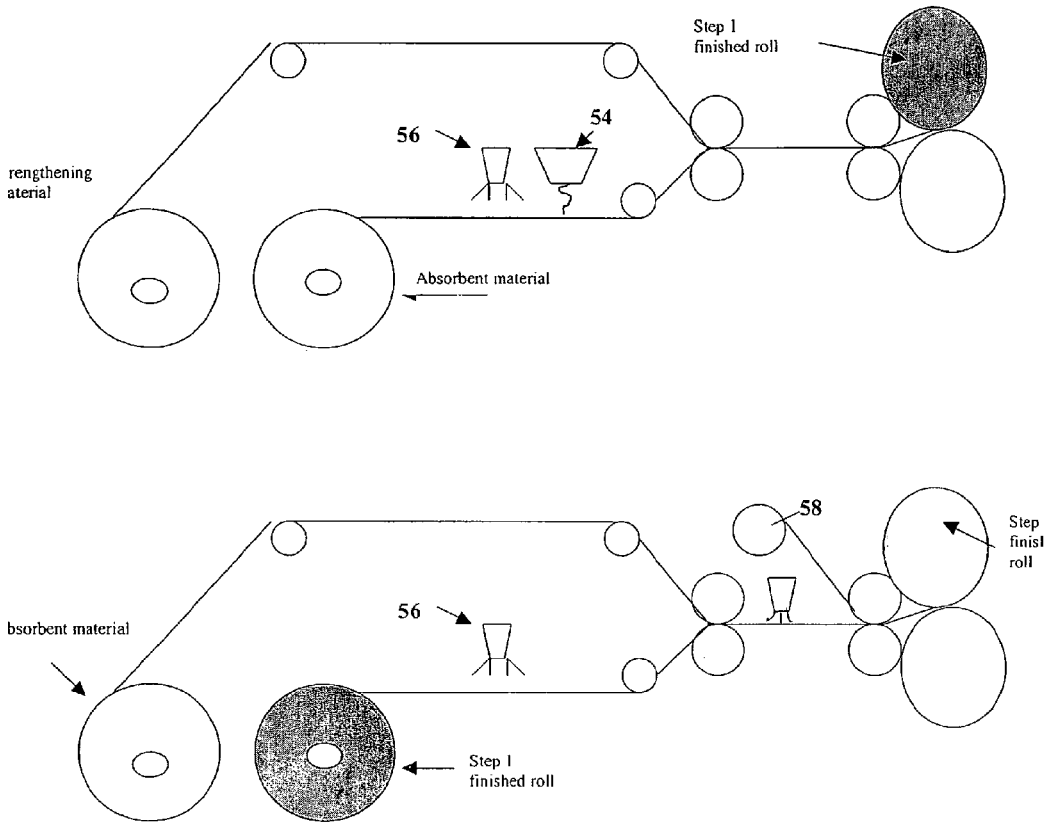
FIG. 12 is a schematic of a process flow to make the base materials of the present disclosure where an antimicrobial is a powder.

Referring to FIG. 12, a schematic of a process flow to produce materials used in the present disclosure is illustrated. These materials are later used in the construction of the transporter. FIG. 12 illustrates the process to combine an aspect of the absorbent core, strengthening material, and antimicrobial powder. In the first step shown, a piece of absorbent material is unwound, and hot melt adhesive 56 is sprayed on the top surface. Antimicrobial powder 54 is dropped onto the adhesive layer (to help bind it in place), and then covered with the strengthening substrate material to form the "finished roll" shown. In step 2, the "finished roll" produced in step 1 is further processed with a second absorbent core material that is bonded to it with a hot melt adhesive 56, and polyethylene backing material 58 is added. The completed roll from step 2 is later converted into the finished cut pads used for an embodiment of the present transporter.

Figure 13:
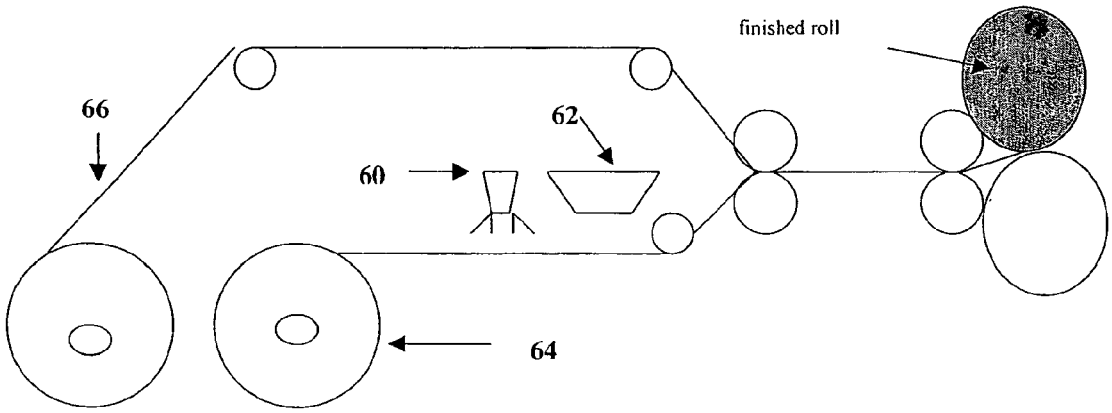
FIG. 13 is a schematic of a process flow to make the base materials of the present disclosure where an antimicrobial is a liquid.

FIG. 13 is a schematic of a process flow analogous to that in FIG. 12, but using a liquid antimicrobial instead of powder. The change from FIG. 12 occurs in the first step, where antimicrobial liquid spray 60 is used, followed by drying 62 by heat, by heated roll segments or a drying oven.

Referring to FIG. 14, an embodiment of the transporter 10 having an anti-hypothermia structure is illustrated. Two or more material segments 64, 66 (also called cover layers) are connected along the lengthwise edge length of the transporter (two such material segments are shown in the embodiment shown in FIG. 14). Material segments 64, 66 are each folded approximately $\frac{2}{3}^{rds}$ of the distance across the width of transporter 10, so as to overlap each other. For example, where the outer dimensions of transporter 10 are about 78 inches in length by about 33.5 inches in width, material segments 64, 66 are each about 24 inches to about 28 inches wide, and more preferably material segments 64, 66 are each about 26 inches wide. Material segments 64, 66 can be shaped and connected along the length of the transporter, preferably using a stitch pattern 68 that does not enclose and thus permits full use of gripping devices 72. Stitch pattern 68 is but one embodiment of many possible stitch patterns that secure material segments 64, 66 to transporter 10 while leaving gripping devices 72 free for use.

Material segments 64, 66 overlap each other in the middle third section of transporter 10 so that, when a person is placed on the transporter, the material segments can be placed on the person to act as a blanket that retains body heat and prevents hypothermia, in much the same way that a sleeping bag operates to retain body heat.

Material segments 64, 66 can be made of one or more layers. The one or more material segments can include an outer layer, an inner layer, and an insulating layer positioned between the outer layer and the inner layer. The insulating layer can be a single layer, or can be two or more layers. The insulating later is made of one or more lightweight insulating materials that are selected from the group consisting of fleece, nylon, cotton, wool, pile, polyester, polytetrafluoroethylene (PTFE), hollow-core polyester fibers, nylon/polyester blends, polyethylene, polypropylene, and any combinations thereof. These include commercially-available products such as GORE-TEX®, THERMO-LITE®, and CAMBRELLE®. An embodiment of the transporter uses material segments having a 2, 4, or 6 ounce fleece with 210 nylon backing. The fleece functions to keep the person warm and reduce loss of body heat. The outer layer has a barrier material to protect against wind and/or wetness, and the barrier material includes, but is not limited to, nylon, polyethylene, polypropylene, polyester, nylon/polyester blend, cloth, polytetrafluoroethylene (PTFE), PTFE laminate, hollow-core polyester fiber, and any combinations thereof. The inner layer has a vapor-permeable layer to transfer moisture away from the person carried on the transporter. The inner layer is made of polyester, polyethylene, polypropylene, and any combinations thereof.

To reduce the loss of body heat, material segments 64, 66 are placed on, and wrapped over, the person. Fastening strap 74 and fastening device 76 further secure material segments 64, 66 in their covering positions over the person, and secure the person to transporter 10. Fastening device 76 is shown as a buckle in FIG. 14, but can be any fastening means, such as VELCRO®. In FIG. 14, the fastening device 76 and fastening strap 74 are shown in an open position.

The anti-hypothermia properties of transporter 10 can be further enhanced by use of electrical or chemical warming devices. Warmers may be positioned anywhere in transporter 10, such as in pockets within backing substrate 12 or material segments 64, 66. The access slits may be used to insert the warming devices. Warming devices may be powered by batteries, or generate heat by chemical reactions.

Backing substrate 70 in the embodiment shown in FIG. 14 also prevents heat loss and contributes to the anti-hypothermia properties of the transporter. Backing substrate 70, which may be made of polyethylene, polypropylene, nylon, nylon-based material, and/or similar material (and/or composite of materials), serves as a barrier layer to keep cold, wind, and wetness away from the person and to reflect heat back in.

The anti-hypothermia properties of the transporter function to retain body heat of the person being transported, but also assist in the perception of comfort of the person, namely the feeling of being warm and dry.

The material used for the backing substrate 70 is preferably puncture-resistant. Puncture resistance of the backing substrate 70 is particularly useful in those locations where transporter 10 is likely to be used to carry a person over rugged terrain or rough surfaces, especially where a single person is effecting a rescue and carry, where the transporter may need to be dragged along the ground.

Figure 15:
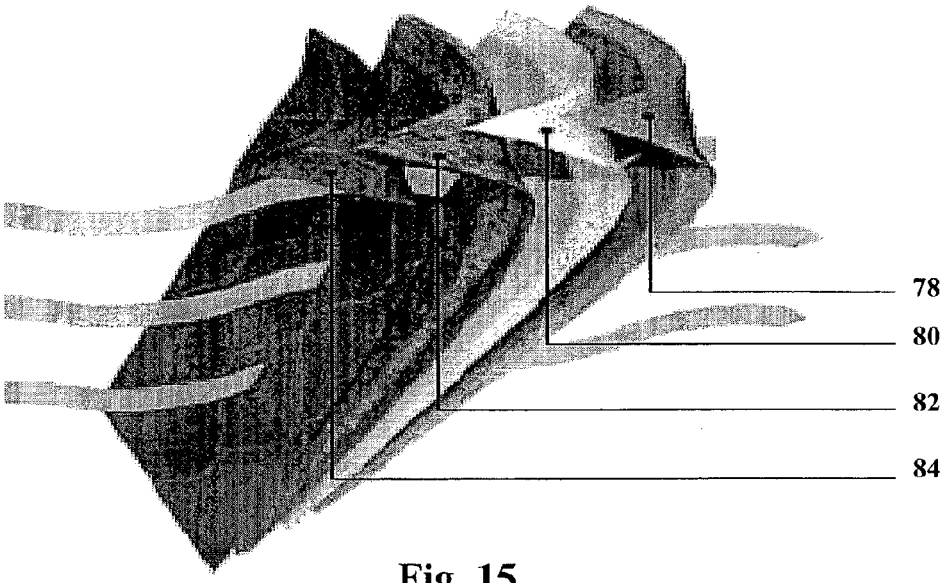
FIG. 15 illustrates the layer-by-layer sections of the backing substrate for an embodiment of the transporter.

FIG. 15 is a layer-by-layer illustration of the bottom portion of transporter 10. Top layer 84 is closest to the person being transported. The next layer is an inner, strengthening layer 82. The next layer is an inner or bottom absorbent layer 80. The next layer is an outermost layer 78 that serves as a barrier layer. Outermost layer 78 is preferably made of polyethylene.

Figure 16:
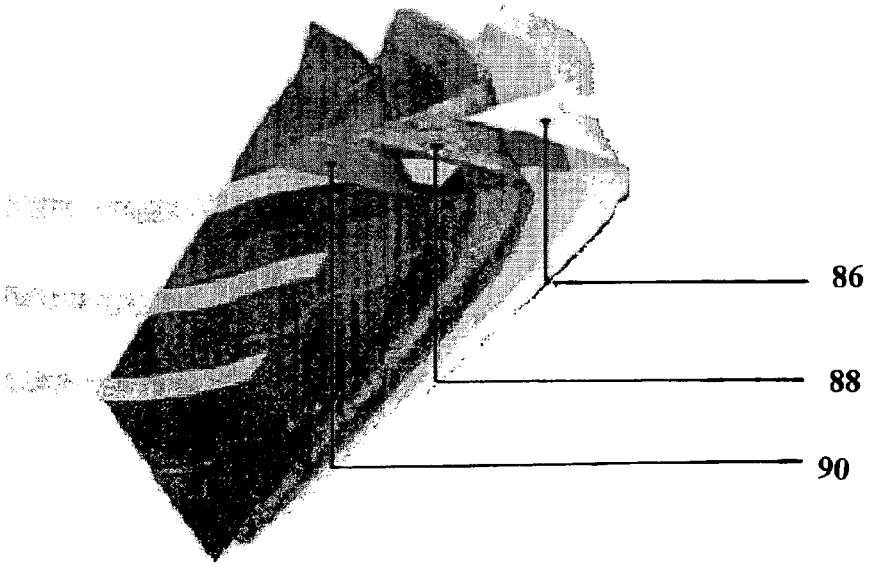
FIG. 16 illustrates the layer-by-layer sections of an embodiment of the material segment that is an anti-hypothermia structure for the transporter.

FIG. 16 is a layer-by-layer illustration of material segments having anti-hypothermia properties. Inner layer 90 is positioned closest to the person being transported. Thereon is middle or insulating layer 88, followed by outer layer 86. Outer layer 86 provides wind and/or moisture protection. Various materials can be used for outer layer 86, including GORE-TEX, 60/40 cloth, cordura, windstopper (PTFE laminate) and nylon. Middle layer 88 is for insulation and reducing heat loss. Middle layer 88 can be fleece, pile, wool, or even thicker polyester blends of material. Middle layer 88 can be a multiple insulative layer design or a single material layer. As shown in FIG. 16, middle layer 88 is shown as a single layer, lightweight fleece material. Inner layer 90 is typically a polyester, polypropylene, or similar material, that is highly vapor permeable so that moisture is transferred or "wicked" away from the person through to the next layers. As shown in FIG. 16, inner layer 90 is a polypropylene-based non-woven to facilitate the quick wicking of moisture away from the person being transported.

Transporters 10 of the present disclosure are suited for use for transporting persons in mass-casualty situations, where large numbers of injured, ill, wounded, or dead persons must be moved to a more healthful environment of health care center quickly.

In battlefield situations, injured soldiers or civilians may need to be moved over rugged terrain, in inclement weather, and/or by air or water rescue. In such circumstances, the injured person may be bleeding, or involuntarily evacuating his bowels or bladder. The absorbent body of transporter 10 is able to provide a safer environment for the person being transported, as well as reducing contamination of others. The absorbent body also reduces the likelihood that the person will slip on or even fall off the transporter, which was a danger with conventional stretchers in such circumstances. Absorption of body fluids not only make transport more safe, but adds to the comfort and perception of well-being of the injured person.

The transporter's straps and buckles also help secure the person, also reducing the likelihood that the person will slip to one side or even off of the transporter. An additional mechanism to secure the person during transport is to join together the two or more material segments with a fastening device (such as the strap and buckle) used in anti-hypothermia embodiments of the present disclosure.

Transporters 10 of the present disclosure are also well-suited for use in battlefield situations by medics and front-line troops required to rapidly rescue and transport injured soldiers and civilians, who may have large injuries and situated in hostile environments or in rough terrain, where exposure to further injury could result from slow transport. Also, the risk of hypothermia is naturally greater where the injury occurs far from a medical center, adding benefit to the anti-hypothermia features of embodiments.

The small storage volumes of the transporters 10 and/or the transporter kits, and their light weight, make it feasible to store a large number of the transporters at stadiums, office building, airports, and other locations where large groups of people gather. Transporter 10 is also well-suited for first-response units, such as ambulance teams, firemen, police, Hazmat units, forestry units, and National Guard units. Instances where the transporters would be of great utility are mass casualties following natural disasters, such as hurricanes, fires, epidemics, blizzards, and/or flooding, as well as man-made disasters, such as airline crashes, train accidents, terror attacks, and/or large automobile accidents.

Other uses for transporters of the present disclosure include recreational users, such as hikers, bikers, climbers, boaters, who may be injured far from areas where ambulances can reach, yet the demands of the recreation activity only permit limited equipment and weight that can be carried for emergencies. The small weight and volume of transporter 10 make it suitable to be carried to the site of recreational activities.

The present disclosure provides a method of using a transporter of the present disclosure including the following steps. Where, for example, transporter 10 is part of kit 38, transporter 10 is removed from case 40, and the transporter 10 is unfolded. Where transporter 10 is not part of kit 38, the transporter is simply opened. A person to be carried is positioned on top of absorbent body 14 of transporter 10. One or more carriers lift transporter 10 (and the person positioned thereon) using gripping device 16, by manually gripping the cutouts or holes, or by inserting rigid bodies 28, such as metal poles, through gripping device 16, and lifting the rigid bodies and transporter 10. The carriers then move transporter 10 and person thereon for a desired distance.

The method of using the transporter may further include securing the person to transporter 10 by securing straps.

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances that fall within the scope of the appended claims.

What is claimed is:

1. A transporter for carrying a person, comprising:

a backing substrate, said backing substrate having edge surfaces;

an absorbent body secured to a first surface of said backing substrate, said absorbent body comprising a superabsorbent material for absorbing a large amount of body fluids exuded from the person;

a gripping device in said backing substrate that is unencumbered by said absorbent body, said gripping device comprising a hole positioned in said backing substrate; and an anti-hypothermia structure separate from said absorbent body, said anti-hypothermia structure being part of said backing substrate and connected to said edge surfaces of the transporter, wherein when the person is placed on said absorbent body on the transporter, said absorbent body contacts only the back portion of the person carried thereon to absorb exuded body fluids and thereby acts to dry the person, and wherein the remainder of the person is covered by said anti-hypothermia structure to preserve warmth and reduce loss of body heat of the person.

2. The transporter according to claim 1, wherein the transporter has a total weight that is less than 4 pounds.

3. The transporter according to claim 1, wherein said anti-hypothermia structure further comprises one or more material segments, and wherein at least one of said one or more material segments extends at least one-half way across an extant of the transporter.

4. The transporter according to claim 3, wherein said one or more material segments are removably connected to the transporter.

5. The transporter according to claim 3, wherein said one or more material segments comprise at least two material segments each connected to a different side of the transporter, and wherein said at least two material segments can be placed on the person carried on the transporter to reduce loss of body heat.

6. The transporter according to claim 5, wherein said at least two material segments are secured together by one or more fasteners to cover the person carried on the transporter.

7. The transporter according to claim 3, wherein said one or more material segments comprise:

an outer layer;

an inner layer; and an insulating layer positioned between said outer layer and said inner layer.

8. The transporter according to claim 7, wherein said insulating layer is two or more layers.

9. The transporter according to claim 7, wherein said insulating layer comprises one or more lightweight insulating materials.

10. The transporter according to claim 7, wherein said outer layer has a barrier material to protect against wind and/or wetness.

11. The transporter according to claim 7, wherein said inner layer has a vapor-permeable layer to transfer moisture away from the person carried on the transporter.

12. The transporter according to claim 3, wherein the transporter further comprises one or more access slits through said one or more material segments, and wherein said access slits are closeable.

13. The transporter according to claim 1, wherein said anti-hypothermia structure is attached to said backing substrate and away from said absorbent body on said backing substrate in order to form an outer layer of the transporter so that the person in contact with said absorbent body has reduced loss of body heat through the transporter.

14. The transporter according to claim 1, further comprising an active agent selected from the group consisting of an antimicrobial, bactericide, fungicide, virucide, disinfectant, sanitizer, sterilizer, mildewstat, surfactant, deodorizer, and any combinations thereof.

15. The transporter according to claim 1, wherein said absorbent body is removably attached to said backing substrate.

16. The transporter according to claim 1, wherein said gripping device is two or more gripping devices, and said gripping device further comprises a rigid body that can be passed through said two or more gripping devices.

17. The transporter according to claim 1, further comprising one or more securing straps.

18. The transporter according to claim 1, wherein the transporter has a weight that is less than about 150 grams per square meter ($g/m^2$).

19. The transporter according to claim 1, wherein the transporter is of a strength sufficient to carry a person weighing at least 250 pounds (113.4 kg).

20. A transporter for carrying a person, comprising:

a backing substrate;

an absorbent body secured to a first surface of said backing substrate, said absorbent body comprising a superabsorbent material for absorbing a large amount of body fluids exuded from the person;

a gripping device in said backing substrate that is unencumbered by said absorbent body, said gripping device comprising a hole positioned in said backing substrate; and an anti-hypothermia structure comprising one or more material segments connected to said transporter, wherein said one or more material segments comprises an inner layer positioned closest to the person being carried on the transporter, wherein said inner layer is vapor-permeable and transfers moisture away from the person, wherein when the person is placed on the transporter, said absorbent body contacts only the back portion of the person carried thereon to absorb exuded body fluids and thereby acts to dry the person, and wherein the remainder of the person is covered by said anti-hypothermia structure to preserve warmth and reduce loss of body heat.

* * * * *